US008381457B2

(12) United States Patent
Ellen

(10) Patent No.: US 8,381,457 B2
(45) **Date of Patent: *Feb. 26, 2013**

(54) DOMED STEEL ROOF FRAME

(75) Inventor: Murray Ellen, New South Wales (AU)

(73) Assignee: S2 Holdings Pty Limited, North Ryde (AU)

( * ) Notice: Subject to any disclaimer, the term of this patent is extended or adjusted under 35 U.S.C. 154(b) by 0 days.

This patent is subject to a terminal disclaimer.

(21) Appl. No.: 12/819,590

(22) Filed: Jun. 21, 2010

(65) Prior Publication Data

US 2010/0269421 A1 Oct. 28, 2010

Related U.S. Application Data

(63) Continuation of application No. 11/905,104, filed on Sep. 26, 2007, now abandoned.

(30) Foreign Application Priority Data

Jun. 13, 2007 (AU) ..... 2007903173

(51) Int. Cl.
*E04B 7/10* (2006.01)

(52) U.S. Cl. ..... 52/81.3; 52/81.1; 52/81.2; 52/80.2; 52/639; 52/643

(58) Field of Classification Search ..... 52/80.1, 52/81.1, 80.2, 639, 643, 644, 81.3, 640, 222, 52/6

See application file for complete search history.

(56) References Cited

U.S. PATENT DOCUMENTS

| | | | | |
|---|---|---|---|---|
| 1,554,061 | A | | 9/1925 | Hamilton |
| 3,579,932 | A | | 5/1971 | Atkinson |
| 3,638,368 | A | | 2/1972 | Pierson |
| 3,667,173 | A | | 6/1972 | Billgren |
| 3,676,964 | A | | 7/1972 | Anglade |
| 3,765,134 | A | | 10/1973 | Gilchrist |
| 3,872,634 | A | | 3/1975 | Seaman |
| 4,052,834 | A | | 10/1977 | Ellen |
| 4,241,746 | A | | 12/1980 | Rothe |
| 4,325,207 | A | | 4/1982 | Russell |
| 4,373,305 | A | | 2/1983 | Russell |
| 4,676,045 | A | | 6/1987 | Ellen |
| 4,890,429 | A | | 1/1990 | Gatzka et al. |
| 5,146,719 | A | | 9/1992 | Saito et al. |
| 5,159,790 | A | | 11/1992 | Harding |
| 5,269,106 | A | * | 12/1993 | Stafford et al. ..... 52/63 |
| 5,355,641 | A | * | 10/1994 | Levy ..... 52/66 |
| 5,371,983 | A | | 12/1994 | Kawaguchi et al. |
| 5,502,928 | A | | 4/1996 | Terry |
| 5,653,066 | A | * | 8/1997 | Schildge, Jr. ..... 52/66 |
| 5,857,294 | A | | 1/1999 | Castro |
| 6,047,513 | A | * | 4/2000 | Gibson ..... 52/646 |
| 6,192,634 | B1 | | 2/2001 | Lopez |
| 6,282,842 | B1 | | 9/2001 | Simens |
| 6,874,285 | B2 | | 4/2005 | Wilson |
| 2005/0210767 | A1 | | 9/2005 | DeFever et al. |

* cited by examiner

*Primary Examiner* — William Gilbert
*Assistant Examiner* — Alp Akbasli
(74) *Attorney, Agent, or Firm* — McDonnell Boehnen Hulbert & Berghoff LLP

(57) ABSTRACT

A domed steel roof frame (12). The frame (12) has at least three corners and an outwardly convex shape with an uppermost apex (20). The frame (12) comprises at least three steel interior members (18), at least three interior cable retainers and at least three interior cables. The at least three steel interior members (18) each extend from one of each of the corners to the apex (20). The at least three interior cable retainers are each attached to, or form part of, and extending substantially along each of the respective interior members (18). The at least three interior cables are each inserted through each of the respective interior cable retainers. The frame (12) also comprises means to tension each of the interior cables relative to their respective interior cable retainers and means to maintain each of the interior cables tensioned relative to their respective interior cable retainers.

16 Claims, 3 Drawing Sheets

DOMED STEEL ROOF FRAME

CROSS REFERENCED RELATED APPLICATIONS AND CLAIM OF PRIORITY

The present application is a continuation of U.S. patent. application Ser .No. 11/905,104, which is incorporated by reference herein in its entirety.

The present application claims priority to Australian Provisional Application No. 2007903173 filed on Jun. 13, 2007.

TECHNICAL FIELD

The present invention relates to a domed steel roof frame and a method of building a domed steel roof frame.

The invention has been primarily developed for use in domed steel roof structures for large industrial, commercial and sporting complexes and will be described hereinafter with reference to these applications. However, the invention is not limited to these applications and is also suitable for other steel structural and architectural works.

BACKGROUND OF THE INVENTION

When designing a domed steel roof structure, consideration must be given to, amongst other requirements, requirements of strength, deflection and dynamics. It is common for additional material to be required in a structure to satisfy deflection requirements, when compared to the material required to satisfy strength requirements. The additional material increases material and construction costs and can also adversely affect the building's dynamic response (particularly to earthquakes) and also requires a corresponding increase in the building's foundations.

It is important that the amount of materials used in a domed steel roof structure is minimised from a cost and environmental stand point. It is an object of the present invention to reduce material required in such a structure whilst still satisfying deflection criteria.

SUMMARY OF THE INVENTION

Accordingly, in a first aspect, the present invention provides a domed steel roof frame, the frame having at least three corners and an outwardly convex shape with an uppermost apex, the frame comprising:

at least three steel interior members, each extending from one of each of the corners to the apex;

at least three interior cable retainers, each attached to, or forming part of, and extending substantially along each of the respective interior members;

at least three interior cables, each inserted through each of the respective interior cable retainers;

means to tension each of the interior cables relative to their respective interior cable retainers; and means to maintain each of the interior cables tensioned relative to their respective interior cable retainers.

The frame preferably also includes:

at least three steel peripheral members, each extending between adjacent pairs of the at least three corners; and at least three peripheral cable retainers, each attached to, or forming part of, and extending substantially along each of the respective peripheral members;

at least three peripheral cables, each inserted through each of the respective peripheral cable retainers;

means to tension each of the peripheral cables relative to their respective peripheral cable retainers; and means to maintain each of the peripheral cables tensioned relative to their respective peripheral cable retainers.

In a second aspect, the present invention provides a domed steel roof frame, the frame having at least four corners and an outwardly convex shape with an uppermost apex, the frame comprising:

at least two steel interior members, each extending between each of the pairs of opposite corners and intersecting at the apex;

at least two interior cable retainers, each attached to, or forming part of, and extending substantially along each of the respective interior members;

at least two interior cables, each inserted through each of the respective interior cable retainers;

means to tension each of the interior cables relative to their respective interior cable retainers; and means to maintain each of the interior cables tensioned relative to their respective interior cable retainers.

The frame preferably also includes:

at least four steel peripheral members, each extending between adjacent pairs of the at least four corners; and at least four peripheral cable retainers, each attached to, or forming part of, and extending substantially along each of the respective peripheral members;

at least four peripheral cables, each inserted through each of the respective peripheral cable retainers;

means to tension each of the peripheral cables relative to their respective peripheral cable retainers; and means to maintain each of the peripheral cables tensioned relative to their respective peripheral cable retainers.

In a third aspect, the present invention provides a domed steel roof frame, the frame having four corners and an outwardly convex shape with an uppermost apex, the frame comprising:

two steel interior members, each extending between each of the pairs of opposite corners and intersecting at the apex;

two interior cable retainers, each attached to, or forming part of, and extending substantially along each of the respective interior members;

two interior cables, each inserted through each of the interior cable retainers;

means to tension each of the interior cables relative to their respective interior cable retainers; and means to maintain each of the interior cables tensioned relative to their respective interior cable retainers.

The frame preferably also includes:

four steel peripheral members extending between adjacent pairs of the four corners; and four peripheral cable retainers, each attached to, or forming part of, and extending substantially along each of the respective peripheral members;

four peripheral cables, each inserted through each of the respective cable retainers;

means to tension each of the peripheral cables relative to their respective peripheral cable retainers; and means to maintain each of the peripheral cables tensioned relative to their respective peripheral cable retainers.

The interior members are preferably each in the form of a steel truss. The trusses preferably each have a hollow lower chord which defines the cable retainer of the respective interior member.

The peripheral members are preferably each in the form of a hollow steel tube which define the cable retainer of the respective peripheral members. The peripheral members are each attached to a plurality of diagonal steel trusses, which together form the outer surface of the roof frame.

The means to tension each of the peripheral cables relative to their respective peripheral cable retainers are preferably mechanical jacking devices.

In one form, the means to maintain each of the cables tensioned relative to their respective cable retainers are permanent, such as a grout or other adhesive between the tensioned cables relative to their respective cable retainers. In another form, the means to maintain each of the cables tensioned relative to their respective cable retainers are non-permanent, such as a clamp, anchor, multi-use barrel and wedge or other similar releasable device on the tensioned cables adjacent to the ends of their respective cable retainers.

In a fourth aspect, the present invention provides a method of building a domed steel roof frame, the frame having at least three corners and an upwardly outwardly convex shape with an uppermost apex, the frame comprising:

at least three steel interior members, each extending from one of each of the corners to the apex;

at least three interior cable retainers, each attached to, or forming part of, and extending substantially along each of the respective interior members;

at least three interior cables, each of the cables inserted through each of the respective interior cable retainers; and means to tension each of the interior cables relative to their respective interior cable retainers, the method comprising:

1. assembling the frame;
2. inserting one of the interior cables into the interior cable retainer of each of the respective interior members;
3. applying a tensile force to each of the interior cables, relative to their respective interior cable retainers; and
4. after step 3, maintaining each of the interior cables tensioned relative to their respective interior cable retainers.

The frame preferably also includes:

at least three peripheral steel members, each extending between adjacent pairs of the at least three corners; and at least three peripheral cable retainers, each attached to, or forming part of, and extending substantially along each of the respective peripheral members;

at least three peripheral cables, each inserted through each of the respective peripheral cable retainers; and means to tension each of the peripheral cables relative to their respective peripheral cable retainers, the method also comprising:

5. inserting one of the peripheral cables into the cable retainer of each of the respective peripheral members;
6. applying a tensile force to each of the peripheral cables, relative to their respective peripheral cable retainers; and
7. after step 6, maintaining each of the peripheral cables tensioned relative to their respective peripheral cable retainers.

In a fifth aspect, the present invention provides a method of building a domed steel roof frame, the frame having at least four corners and an upwardly outwardly convex shape with an upper apex, the frame comprising:

at least two interior steel members, each extending between each of the pairs of opposite corners and intersecting at the apex;

at least two interior cable retainers, each attached to, or forming part of, and extending substantially along each of the respective interior members;

at least two interior cables, each inserted through each of the respective interior cable retainers; and means to tension each of the interior cables relative to their respective interior cable retainers, the method comprising:

1. assembling the frame;
2. inserting one of the interior cables into the interior cable retainer of each of the respective interior members;
3. applying a tensile force to each of the cables, relative to their respective cable retainers; and
4. after step 3, maintaining each of the interior cables tensioned relative to their respective interior cable retainers.

The frame preferably also includes:

at least four peripheral steel members, each, extending between. adjacent pairs of the at least four corners; and at least four peripheral cable retainers, each attached to, or forming part of, and extending substantially along each of the respective peripheral members;

at least four peripheral cables, each inserted through each of the respective peripheral cable retainers; and means to tension each of the peripheral cables relative to their respective peripheral cable retainers, the method also comprising:

5. inserting one of the peripheral cables into the peripheral cable retainer of each of the respective peripheral members;
6. applying a tensile force to each of the peripheral cables, relative to their respective peripheral cable retainers; and
7. after step 6, maintaining each of the peripheral cables tensioned relative to their respective peripheral cable retainers.

In a sixth aspect, the present invention provides a method of building a domed steel roof frame;

the frame having four corners and an upwardly outwardly convex shape with an uppermost apex, the frame comprising:

two interior steel members extending between each of the pairs of opposite corners and intersecting at the apex;

at least two interior cable retainers, each attached to, or forming part of, and extending substantially along each of the respective interior members;

at least two interior cables, each inserted through each of the respective interior cable retainers; and means to tension each of the interior cables relative to their respective interior cable retainers, the method comprising:

1. assembling the frame;
2. inserting one of the interior cables into the interior cable retainer of each of the respective interior members;
3. applying a tensile force to each of the interior cables, relative to their respective interior cable retainers; and
4. after step 3, maintaining each of the interior cables tensioned relative to their respective interior cable retainers.

The frame preferably also includes:

four peripheral steel members extending between adjacent pairs of the four corners; and at least four peripheral cable retainers, each attached to, or forming part of, and extending substantially along each of the respective peripheral members;

at least four peripheral cables, each inserted through each of the respective peripheral cable retainers; and means to tension each of the peripheral cables relative to their respective peripheral cable retainers, the method also comprising:

5. inserting one of the peripheral cables into the peripheral cable retainer of each of the respective peripheral members;

6. applying a tensile force to each of the peripheral cables, relative to their respective peripheral cable retainers; and
7. after step 6, maintaining each of the peripheral cables tensioned relative to their respective peripheral cable retainers.

In one form, the fixing of the tensioned cables relative to their respective cable retainers is permanent, such as a grout or other adhesive between the tensioned cables and their respective cable retainers. In another form, the fixing of the tensioned cables relative to their respective cable retainers is non-permanent, such as a clamp, anchor, multi-use barrel and wedge or other releasable device, on the tensioned cables adjacent to the ends of their respective cable retainers.

In a seventh aspect, the present invention provides a domed steel roof structure comprising the domed roof frame according to any of the aspects defined above, and a leg assembly at each of the corners of the domed roof frame.

BRIEF DESCRIPTION OF THE DRAWINGS

Preferred embodiments of the present invention will now be described, by way of examples only, with reference to the accompanying drawings wherein.

DETAILED DESCRIPTION OF THE PREFERRED EMBODIMENTS

Figure 1:
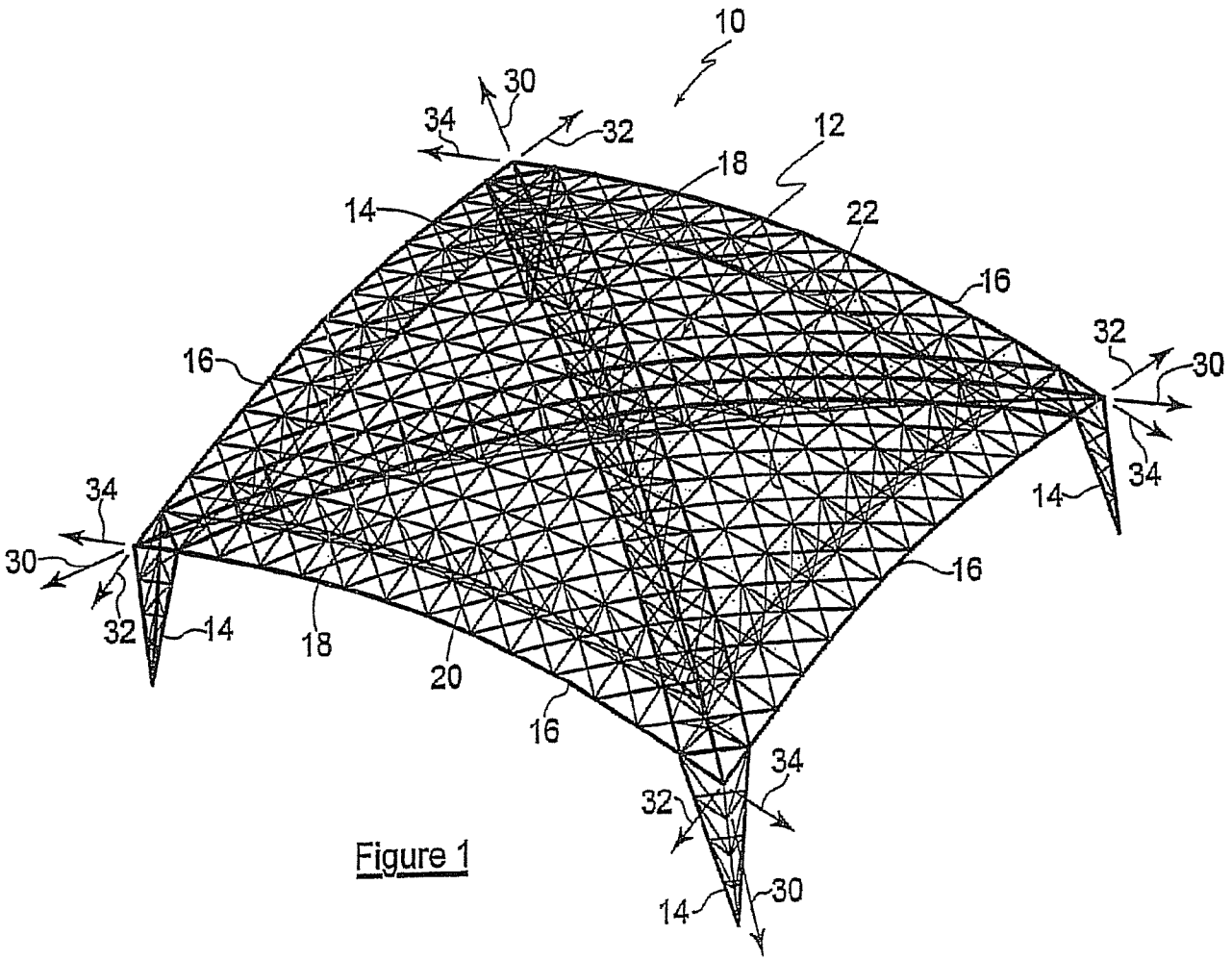
FIG. 1 is an upper perspective view of a first embodiment of a domed steel roof structure.
Figure 2A:
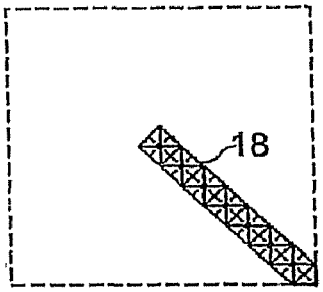
FIGS. 2*a* to 2*j* are top views showing the sequential construction and assembly of the roof frame of the structure shown in FIG. 1.
Figure 2B:
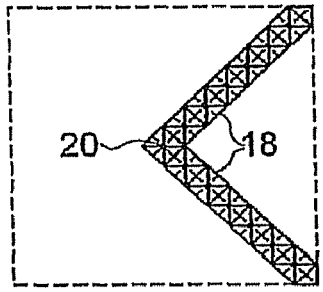
Figure 2C:
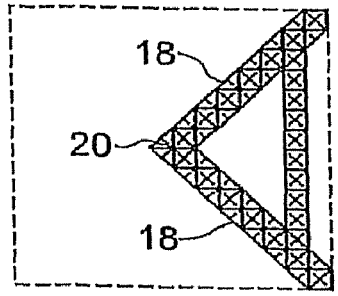
Figure 2D:
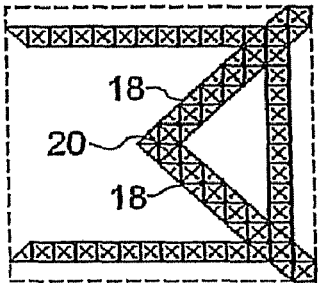
Figure 2E:
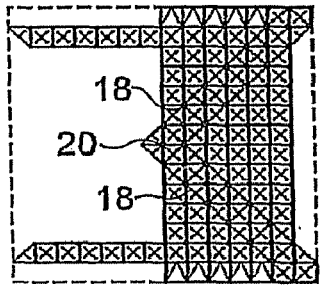
Figure 2F:
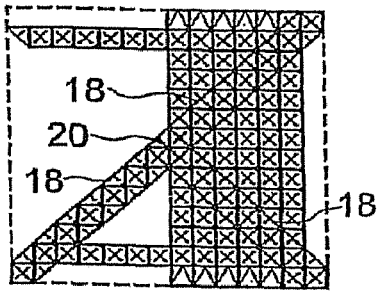
Figure 2G:
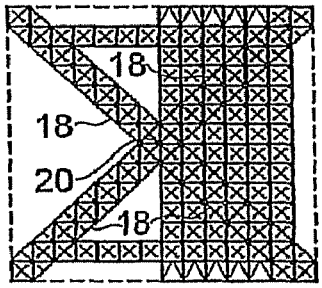
Figure 2H:
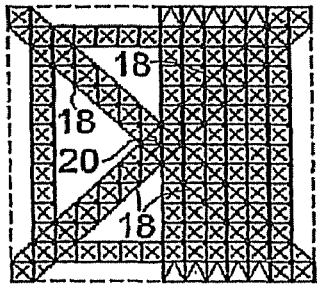
Figure 2I:
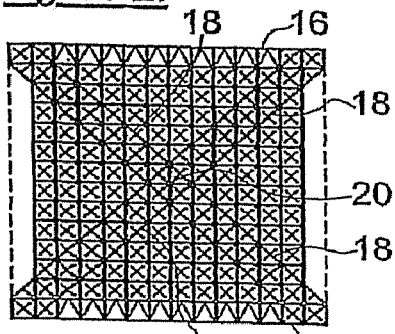
Figure 2J:
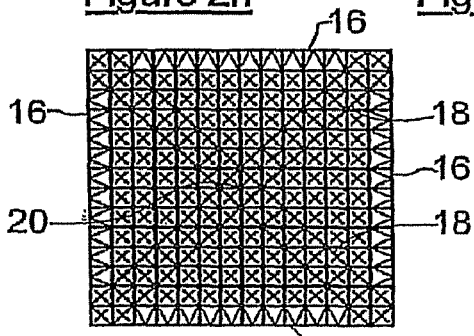

FIG. 1 shows a first embodiment of a domed steel roof structure 10 comprising a domed steel roof frame 12 with a steel leg frame assembly 14 at each of its four corners. The roof frame 12 includes four steel peripheral members 16 and two steel interior members 18.

The peripheral members 16 each extend between adjacent pairs of the corner leg frame assemblies 14 and are each in the form of hollow steel tubular members attached to diagonal trusses.

The two steel interior members 18 extend diagonally between each of the pairs of the opposite corner leg frame assemblies 14 and intersect at the highest point or apex 20 of the roof frame 12. The interior members 18 can also be considered as four interior members which each extend from each of the corner leg frame assemblies 14 to the apex 20.

The peripheral members 16 are each in the form of a steel tubular member, defining a cable retainer. Each of the cable retainers have a respective cable inserted therein.

The interior members 18 are each in the form of a steel truss, such as that as shown in international PCT patent application no. PCT/AU01/00715, the contents of which are incorporated herein by cross reference. The lower chord of each of the interior members 18 are also in the form of a tubular member, defining a cable retainer. Each of these cable retainers also have a respective cable therein.

The remainder of the roof frame 12 is comprised of a lattice of triangular steel trusses 22 of a design suitable for supporting the intended external covering of the roof frame 12.

After the frame 12 has been assembled, the cables in the interior members 18 are tensioned, relative to their respective cable retainers, in the directions of arrow pairs 30. This tensioning in turn applies a compression force to the lower chord of the trusses, and thus the roof frame 12 overall, storing strain energy therein. The cables are maintained tensioned relative to the lower chord member (i.e. cable retainer) of their respective interior member 18 after the tension is applied in order to lock the strain energy in place. For a permanent structure, the cables are fixed relative to the cable retainers by grouting. For a non-permanent or demountable structure, the cables are fixed relative to the cable retainers by clamping the cables adjacent the ends of the cable retainers with a multi-use barrel wedge or other anchor system. In either case, and as a result, the interior members (trusses) 18 resist external tensile forces applied thereto.

The cables in the peripheral members 16 are also tensioned, relative to the respective cable retainers in their respective peripheral members 16, in the direction of arrow pairs 32 and 34. This tensioning in turn applies a compression force to the peripheral members 16 and thus the roof frame 12 overall, storing strain energy therein. The cables are again maintained tensioned relative to their respective peripheral member 16 after the tension is applied in order to lock the strain energy in place. The cables are again similarly fixed (permanently or non-permanently) relative to the cable retainers. As a result, the peripheral members 16 also resist external tensile forces applied thereto.

The roof frame 12 is thus able to withstand far greater loads than a conventional roof frame of similar size and produced from some similar materials. Put another way, the roof frame 12 can be produced in a larger length and width than a conventional frame using the same materials and be able to withstand a similar external load. As an example, if a conventional roof frame is able to have a length and width of 35×35 meters, a roof frame 12 according to an embodiment of the invention produced from similar materials can be produced having dimensions of 80×80 meters. Further, the structure 10 described above can be designed to meet strength and dynamic requirements, whilst reducing the need to increase the material added to the structure 10 to satisfy deflection requirements. The dimensions of the structure 10 can also be increased whilst using the same amount of materials to produce a larger structure for the same material cost. Conversely, a structure 10 with a like span to an existing structure can be produced using a reduced amount of materials. The structure 10 is also lighter and cheaper than existing comparable structures, particularly when foundation savings are taken into account. The structure 10 is also readily adaptable for use in demountable applications.

Mechanisms for tensioning the cables and thereafter locking them relative to the peripheral members 16 and interior member 18 are also disclosed in international application no. PCT/AU01/00715. Further examples of how the cables may be tensioned and fixed relative to their respective cable retainers are also disclosed in international PCT patent application nos. PCT/AU2005/001076 and PCT/AU2005/001075, the contents of which are also incorporated herein by cross reference.

FIGS. 2*a* to 2*j* show sequentially the construction and assembly of the roof frame 12. The previously mentioned cables are inserted into the peripheral members 16 and the interior members 18 after the basic assembly of the roof frame 12 shown in FIG. 2; has been completed. The cables are then each tensioned relative to their respective peripheral member 16 or interior member 18. If desired, the corner leg frame assemblies 14 can also similarly utilise (permanently or non-permanently) tensioned cables therein, as disclosed in international patent application nos. PCT/AU2005/001078 and PCT/AU2005/001077, the contents of which are also incorporated herein by cross-reference.

Figure 3:
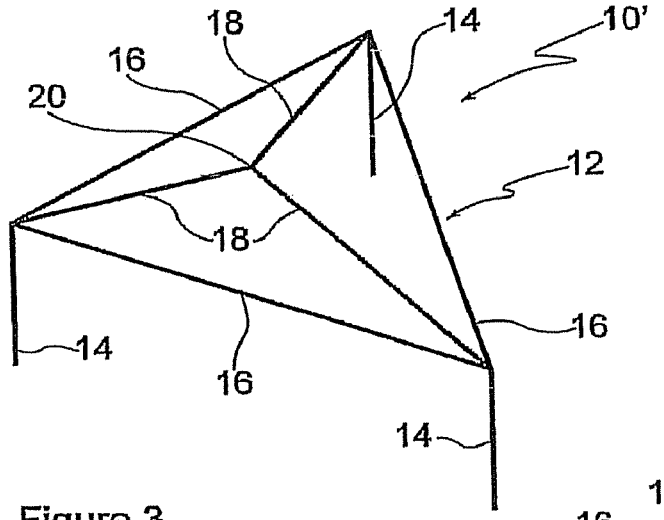
FIG. 3 is a schematic, upper perspective view of a second embodiment of a domed steel roof structure.
Figure 4:
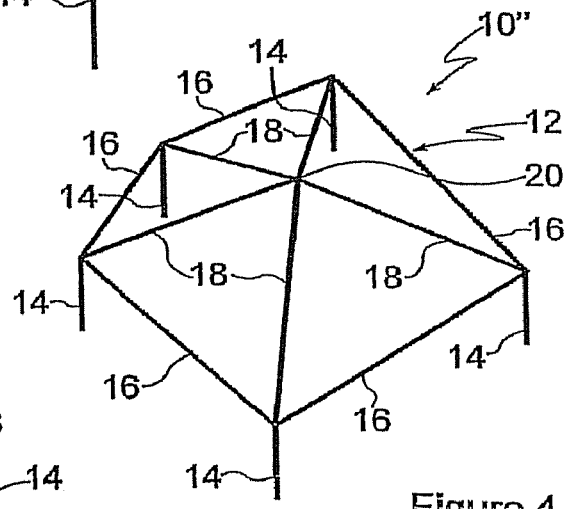
FIG. 4 is a schematic, upper perspective view of a third embodiment of a domed steel roof structure.
Figure 5:
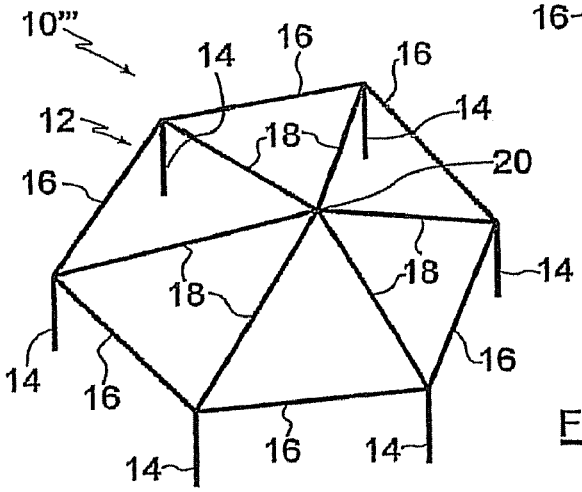
FIG. 5 is a schematic, upper perspective view of a fourth embodiment of a domed steel roof structure.

FIGS. 3, 4 and 5 are each schematic views of second, third and fourth embodiments of domed steel roof structures 10', 10" and 10'" respectively. Like features to those previously described in relation to the first embodiment of the roof structure 10 have been indicated with like reference numerals. The structures 10', 10' and 10'" are all constructed in a substantially identical manner as that described with reference to the structure 10.

Although the invention has been described with reference to preferred embodiments, it will be appreciated by those persons skilled in the art that the invention may be embodied in many other forms. For example, domed roof frames can be constructed having any number of sides in excess of three, having sides of equal or unequal length and having apexes at, or not at, the geometric centre of the roof frame. Further, the cable retainers can be a separate mechanism attached to the peripheral members or the interior members and can be of any shape and can have any number of cables inserted therein. The peripheral members can alternatively be tensioned before the interior members. Finally, if resisting wind loads is the major design factor, frames can be constructed without the peripheral members.

I claim:

1. A domed steel roof frame, the frame having at least four corners and an outwardly convex shape with an uppermost apex, the frame comprising:

at least two steel interior members, each extending between each of the pairs of opposite corners and intersecting at the apex;

at least two tubular interior cable retainers, each attached to, or forming part of, and extending substantially along the entire length of each of the respective interior members;

at least two interior cables, each inserted through each of the respective interior cable retainers;

means for tensioning each of the interior cables relative to their respective interior cable retainers; and means for maintaining each of the interior cables tensioned relative to their respective interior cable retainers.

2. The frame as claimed in claim 1, wherein the frame further includes:

at least four steel peripheral members, each extending between adjacent pairs of the at least four corners; and at least four peripheral cable retainers, each attached to, or forming part of, and extending substantially along each of the respective peripheral members;

at least four peripheral cables, each inserted through each of the respective peripheral cable retainers;

means for tensioning each of the peripheral cables relative to their respective peripheral cable retainers; and means for maintaining each of the peripheral cables tensioned relative to their respective peripheral cable retainers.

3. A domed steel roof frame, the frame having at least three corners and an outwardly convex shape with an uppermost apex, the frame comprising:

at least three steel interior members, each extending from each of the respective corners to the apex;

at least three tubular interior cable retainers, each attached to, or forming part of, and extending substantially along the entire length of each of the respective interior members;

at least three interior cables, each inserted through each of the respective interior cable retainers;

means for tensioning each of the interior cables relative to their respective interior cable retainers; and means for maintaining each of the interior cables tensioned relative to their respective interior cable retainers.

4. The frame as claimed in claim 3, wherein the frame further includes:

at least three steel peripheral members, each extending between adjacent pairs of the at least three corners; and at least three peripheral cable retainers, each attached to, or forming part of, and extending substantially along each of the respective peripheral members;

at least three peripheral cables, each inserted through each of the respective peripheral cable retainers;

means for tensioning each of the peripheral cables relative to their respective peripheral cable retainers; and means for maintaining each of the peripheral cables tensioned relative to their respective peripheral cable retainers.

5. The frame as claimed in claim 3, wherein the interior members are each in the form of a steel truss.

6. The frame as claimed in claim 5, wherein the trusses each have a hollow lower chord which defines the cable retainer of the respective interior member.

7. The frame as claimed in claim 3, wherein the peripheral members are each in the form of a hollow steel tube which define the cable retainer of the respective peripheral members.

8. The frame as claimed in claim 7, wherein the peripheral members are each attached to a plurality of diagonal steel trusses, which together form the outer surface of the roof frame.

9. The frame as claimed in claim 3, wherein the means for tensioning each of the peripheral cables relative to their respective peripheral cable retainers are mechanical jacking devices.

10. The frame as claimed in claim 3, wherein the means for maintaining each of the cables tensioned relative to their respective cable retainers are fixed.

11. The frame as claimed in claim 10, wherein the means for maintaining each of the cables tensioned relative to their respective cable retainers include a grout or other adhesive between the tensioned cables relative to their respective cable retainers.

12. The frame as claimed in claim 3, wherein the means for maintaining each of the cables tensioned relative to their respective cable retainers are nonpermanent.

13. The frame as claimed in claim 12, wherein the means for maintaining each of the cables non-permanently tensioned relative to their respective cable retainers include a clamp, anchor, multi-use barrel and wedge or other similar releasable device on the tensioned cables adjacent to the ends of their respective cable retainers.

14. A domed steel roof structure comprising the domed roof frame according to claim 3, and a leg assembly at each of the corners of the domed roof frame.

15. A domed steel roof frame, the frame having four corners and an outwardly convex shape with an uppermost apex, the frame comprising:

two steel interior members, each extending between each of the pairs of opposite corners and intersecting at the apex;

two tubular interior cable retainers, each attached to, or forming part of, and extending substantially along the entire length of each of the respective interior members;

two interior cables, each inserted through each of the interior cable retainers;

means for tensioning each of the interior cables relative to their respective interior cable retainers; and means for maintaining each of the interior cables tensioned relative to their respective interior cable retainers.

16. The frame as claimed in claim 15, wherein the frame further includes:

four steel peripheral members extending between adjacent pairs of the four corners; and four peripheral cable retainers, each attached to, or forming part of, and extending substantially along each of the respective peripheral members;

four peripheral cables, each inserted through each of the respective cable retainers;

means for tensioning each of the peripheral cables relative to their respective peripheral cable retainers; and means for maintaining each of the peripheral cables tensioned relative to their respective peripheral cable retainers.

* * * * *